US010072662B2

(12) United States Patent
Magyar

(10) Patent No.: US 10,072,662 B2
(45) Date of Patent: Sep. 11, 2018

(54) DYNAMIC SPEED CONTROL FOR PUMP MOTOR

(71) Applicant: Regal Beloit America, Inc., Beloit, WI (US)

(72) Inventor: Justin M. Magyar, Troy, OH (US)

(73) Assignee: Regal Beloit America, Inc., Beloit, WI (US)

( * ) Notice: Subject to any disclaimer, the term of this patent is extended or adjusted under 35 U.S.C. 154(b) by 1063 days.

(21) Appl. No.: 13/830,756

(22) Filed: Mar. 14, 2013

(65) Prior Publication Data

US 2014/0271235 A1 Sep. 18, 2014

(51) Int. Cl.

| | |
|---|---|
| ***F04B 49/00*** | (2006.01) |
| ***F04D 15/00*** | (2006.01) |
| ***F04B 49/06*** | (2006.01) |
| ***F04B 49/10*** | (2006.01) |
| ***F04B 49/20*** | (2006.01) |
| ***F04D 27/00*** | (2006.01) |

(52) U.S. Cl.

CPC ..... *F04D 15/0066* (2013.01); *F04B 49/06* (2013.01); *F04B 49/103* (2013.01); *F04B 49/20* (2013.01); *F04D 27/004* (2013.01); *F04B 2203/0201* (2013.01); *F04B 2203/0209* (2013.01)

(58) Field of Classification Search

CPC ..... F04B 49/06; F04B 49/103; F04B 49/20; F04B 2203/0201; F04B 2203/0209; F04D 15/0066; F04D 27/004

See application file for complete search history.

(56) References Cited

U.S. PATENT DOCUMENTS

| | | | | |
|---|---|---|---|---|
| 2,762,198 | A | 9/1956 | Ullery | |
| 5,013,990 | A | 5/1991 | Weber | |
| 5,213,077 | A * | 5/1993 | Nishizawa et al. | 123/352 |
| 6,247,702 | B1 | 6/2001 | Long et al. | |
| 6,299,699 | B1 | 10/2001 | Porat et al. | |
| 6,778,893 | B2 | 8/2004 | Murakami et al. | |
| 2010/0195784 | A1* | 8/2010 | Hirata et al. | 377/2 |
| 2011/0115318 | A1* | 5/2011 | Hashimoto et al. | 310/78 |
| 2011/0209471 | A1* | 9/2011 | Vanderlaan et al. | 60/446 |
| 2012/0291754 | A1* | 11/2012 | Yamaguchi et al. | 123/458 |

(Continued)

FOREIGN PATENT DOCUMENTS

| | | |
|---|---|---|
| CN | 101012665 | 8/2007 |
| EP | 0017685 A1 | 10/1980 |

(Continued)

*Primary Examiner* — Devon Kramer
*Assistant Examiner* — Christopher Bobish
(74) *Attorney, Agent, or Firm* — Michael Best & Friedrich LLP

(57) ABSTRACT

Systems and methods of controlling the speed of a pump configured to move liquid through a pump system are described. The actual motor speed of the pump motor is controlled by adjusting a current applied to the motor based on the difference between the actual motor speed and the target motor speed according to a gain setting. A first gain value is applied as the gain setting when the difference between the actual motor speed and the target motor speed does not exceed a first threshold. However, a second, higher gain value is applied when the difference between the actual motor speed and the target motor speed exceeds the first threshold.

14 Claims, 3 Drawing Sheets

(56) References Cited

U.S. PATENT DOCUMENTS

| | | | | |
|---|---|---|---|---|
| 2013/0319021 | A1* | 12/2013 | Ball et al. | 62/93 |
| 2015/0091483 | A1* | 4/2015 | Osamura et al. | 318/400.25 |

FOREIGN PATENT DOCUMENTS

| | | | |
|---|---|---|---|
| EP | 0017685 | B1 | 3/1984 |
| EP | 1041220 | A2 | 3/2000 |
| EP | 1041220 | B1 | 9/2007 |
| GB | 590788 | | 7/1947 |
| GB | 814078 | | 5/1959 |
| GB | 912374 | | 12/1962 |
| JP | 2000339036 | | 12/2000 |
| JP | 3302788 | | 7/2002 |
| JP | 3719044 | | 11/2005 |
| JP | 2006029372 | | 2/2006 |
| JP | 2006226318 | | 8/2006 |
| JP | 2007309383 | | 11/2007 |
| JP | 2009029578 | | 2/2009 |
| JP | 2011163486 | | 8/2011 |
| JP | 2011174484 | | 9/2011 |
| JP | 2011174486 | | 9/2011 |
| JP | 2012072694 | | 4/2012 |
| JP | 5097465 | | 12/2012 |
| WO | 2006124006 | | 11/2006 |

* cited by examiner

DYNAMIC SPEED CONTROL FOR PUMP MOTOR

BACKGROUND

The invention relates to systems and method for controlling the speed of a pump motor.

SUMMARY

In one embodiment, the invention provides a pump system comprising a pump configured to move liquid through the pump system and a pump controller. The pump includes a pump motor. The pump controller is configured to control the actual motor speed of the pump motor by adjusting a current applied to the motor based on the difference between the actual motor speed and the target motor speed according to a gain setting. The pump controller applies a first gain value as the gain setting when the difference between the actual motor speed and the target motor speed does not exceed a first threshold. However, the pump applies a second, higher gain value as the gain setting when the difference between the actual motor speed and the target motor speed exceeds the first threshold. Increasing the value of the gain setting causes the pump controller to adjust the current applied to the motor with greater sensitivity in response to the difference between the actual motor speed and the target motor speed.

In some embodiments, the pump controller is configured to apply the first gain value as the gain setting whenever the actual motor speed is less than the target motor speed and to apply the second, higher gain value only when the actual motor speed exceeds the target motor speed by the first threshold.

In another embodiment, the invention provides a motor controller comprising a processor and a memory. The memory stores instructions that are executed by the processor to controller the operation of the motor controller. The motor controller controls the actual speed of a motor by adjusting a current applied to the motor based on the difference between an actual motor speed and a target motor speed according to a gain setting. Increasing the gain setting causes the pump controller to adjust the current applied to the motor with greater sensitivity in response to the differences between the actual motor speed and the target motor speed. The motor controller applies a first value as the gain setting when the difference between the actual motor speed and the target motor speed does not exceed a first threshold. A second gain value is applied when the difference between the actual motor speed and the target motor speed exceeds the first threshold, but does not exceed a second threshold. A third gain value is applied as the gain setting when the difference between the actual motor speed and the target motor speed exceeds both the first threshold and the second threshold. The second gain value is greater than the first gain value, but less than the third gain value.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
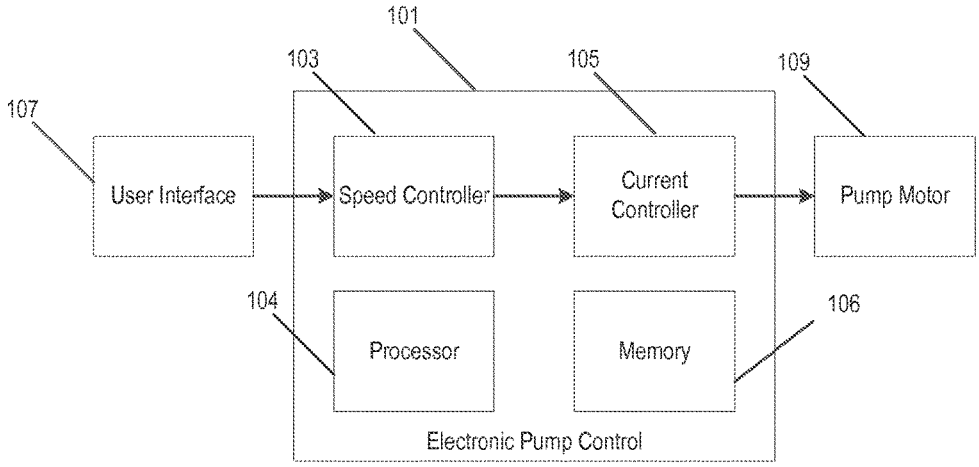
FIG. 1 is a block diagram showing electrical communication between components of a pump system.

FIG. 1 illustrates an example of a pump system for use in applications such as, for example, pools and spas. The electronic pump control unit 101 includes a speed controller 103, a current controller 105, a processor 104, and a memory 106. The memory 106 stores instructions that are executed by the processor to operate the controller as described herein. The speed controller 103 and the current controller 105 in this example include circuit components and software components that are stored on the memory 106 and executed by the processor 104 separate components/circuits.

The electronic pump control unit 101 receives a target speed setting from a user 101. Alternatively, the target speed can be predefined or defined automatically by the pump controller based on observed performance characteristic of the system. The speed controller 103 receives the target speed setting and outputs a current demand value to the current controller 105. The current controller 105 then controllably applies a voltage to the motor 109. The speed of the motor 109 varies based on the load applied to the motor and the current of the motor (based on the voltage applied by the current controller 105).

Figure 2:
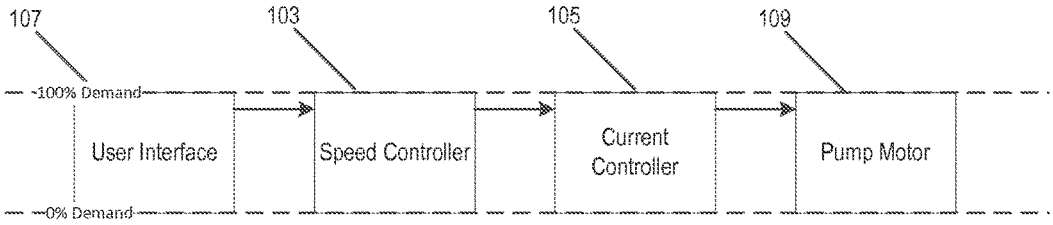
FIG. 2 is a functional schematic diagram illustrating the relative values communicated between the components of the pump system when a valve in the pump system is fully opened.
Figure 3:
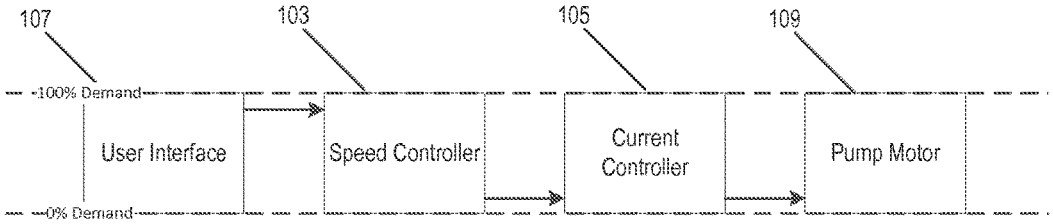
FIG. 3 is a functional schematic diagram illustrating the relative values communicated between the components of the pump system when the valve in the pump system is fully closed.

As the load applied to the motor changes, the current required to operate the motor at the defined target speed also changes. As illustrated in FIG. 2, when a valve in the pump system is in a fully open position, the speed controller 103 outputs a relatively constant current demand to the current controller 105 which, in turn, provides a relatively constant voltage to the motor 109. However, when the valve is closed, the load on the pump motor 109 is reduced. Therefore, as illustrated in FIG. 3, the current demand required to maintain the target speed is also reduced. The speed controller 103 communicates this reduced current demand to the current controller 107 which, in turn, provides a reduced voltage to the pump motor 109.

In order provide the adjustment illustrated in FIGS. 2 and 3, the speed controller monitors the speed of the pump motor 109 and increases or reduces the current demand communicated to the current controller 105 based on the difference between the actual motor speed and the target motor speed. The actual motor speed can be determined, for example, by a speed sensor integrated into the motor, by a flow sensor configured to measure the speed at which liquid moves through the pump system, or based on current feedback from the motor. The speed controller 103 in this example applies a PI (proportional-integral) control algorithm to determine a current adjustment that is appropriate in order to cause the actual motor speed to approach the target motor speed. The current adjustment is also based on a gain setting that defines a relationship between the difference between the target and actual motor speed and corresponding adjustment to the current setting. For example, in a simplified system, the current adjustment is defined by the following equation:

$$\text{Current Adjustment}=\text{Speed Deviation}\times\text{Gain Setting}$$

Similarly, the current controller is configured to monitor the current of the pump motor and adjust the voltage applied to the pump motor to cause the actual motor current to approach the target motor current. In some constructions, the current controller is programmed to know the resistance of the pump motor and, therefore, can calculate the voltage required to achieve the desired current without a further measurement of the actual current. The voltage adjustment is implemented using a device such as, for example, a potentiometer or variable resistor.

Figure 4:
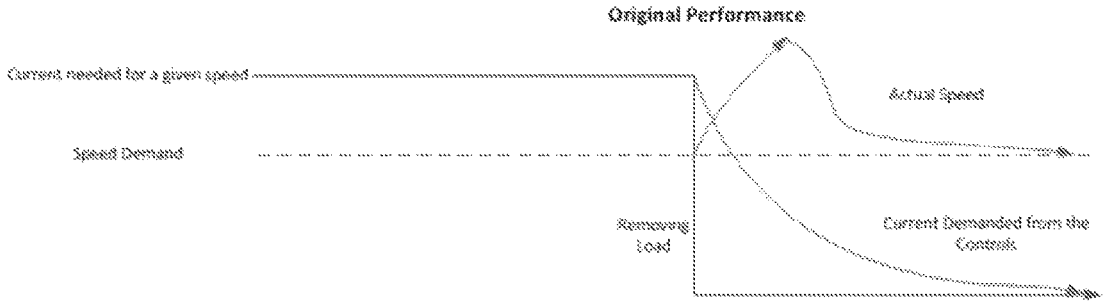
FIG. 4 is a graph illustrating changes in the actual speed of the pump motor and the current applied to the motor when the valve transitions from an open state to a closed state.

As illustrated in FIG. 4, the current required to run the motor at the target speed is reduced when the valve is closed and the load on the pump motor is reduced. However, the speed controller 103 is unable to immediately account for this change in load. Therefore, when the valve is closed and the load reduced, the actual speed of the pump begins to increase above the target speed. The speed controller 103 eventually recognizes this deviation and gradually reduces the current applied to the motor 109 to cause the actual speed to return to the target speed.

The period of time required for the actual speed to again reach the target speed after the valve is closed is directly related to the value of the gain setting applied by the pump controller. A higher gain setting value would cause the controller to be more sensitive to change in pump speed. As a result, the current applied to the pump motor (and, therefore, the actual speed) is reduced at a greater pace. However, a higher gain setting value also causes the pump controller to react more sensitively to relatively minor changes in actual pump speed. The result is a more noticeably, near sinusoidal periodic fluctuation in the actual speed of the pump above and below the target pump speed.

Figure 5:
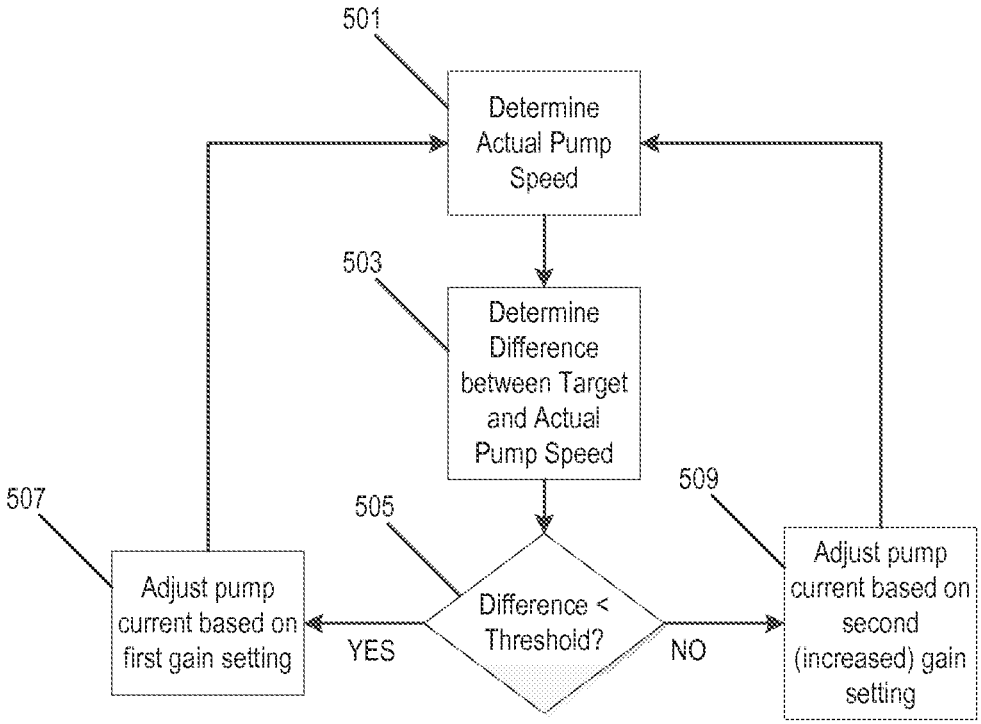
FIG. 5 is a flowchart of a method of controlling the speed of the pump when the valve transitions from the open state to the closed state.

FIG. 5 illustrates a method of controlling the operation of the pump in a way that reduces the amount of time required for the actual pump speed to return to the target pump speed after the load on the pump motor is reduced. The pump controller 101 begins by determining an actual speed of the pump motor (step 501) and determining a difference between the actual pump speed and a target pump speed (step 503). If the difference is less than a defined threshold difference (step 505), the pump current is adjusted based on a first gain setting value. However, if the difference is greater than the defined threshold, the pump current is adjusted based on a second, higher gain setting value (step 509). The second gain setting value can be selected as a value proportional to the first gain setting value—for example, 50% or 100% of the original gain setting value is applied during an overspeed situation.

Figure 6:
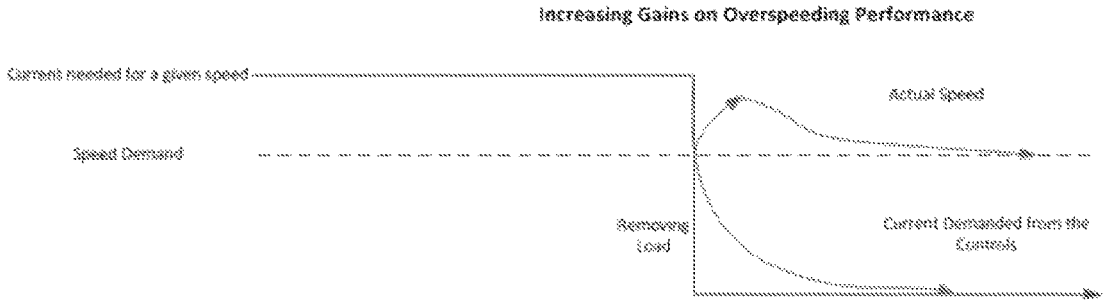
FIG. 6 is a graph illustrating the changes in the actual speed of the pump motor and the current applied to the motor when motor is operated according to the method of FIG. 5.

FIG. 6 illustrates the adjustments to the speed and current of the pump system according to the method of FIG. 5 when the load on the pump motor is reduced during operation of the pump motor (for example, by closing a valve in the pump system). Before the load is reduced, the pump controller 101 applies a near constant current to the motor 109 and achieves a near constant pump speed. However, when the load is reduced or removed from the motor, the pump controller 101 applies the increased gain setting and reduces the current applied to the pump motor at a greater speed. As a result, a short time period is required to cause the actual pump speed to return to the target pump speed. Furthermore, because the increased gain setting allows the pump controller to react more quickly, the maximum actual speed of the pump motor after reducing the load is also decreased.

The method illustrated in FIG. 5 is only one example of a dynamic speed control system for a pump system. In other constructions, two or more thresholds can be applied such that a first gain setting value is applied when the speed deviation does not exceed a first threshold and a second, higher gain setting value is applied when the speed deviation exceeds the first threshold. A third, even higher gain setting value is applied when the speed deviation exceeds a second, higher threshold. Therefore, the greater the deviation between the actual pump speed and the target pump speed, the quicker the pump controller 101 is able to react. Furthermore, in some constructions, instead of adjusting the gain value based on one or more speed deviation thresholds, the gain setting value can be adjusted as a ratio of the speed deviation. In such constructions, the gain value increases constantly as the speed deviation increases.

System with mechanisms for making multiple adjustments to the gain setting may be implemented in situations where multiple valves are used to control multiple applications with the same pump—for example, a system with one valve providing fluid return from a pool and a second valve provide fluid return from a spa. If only one valve is closed, the load is reduced. However, if both valves are closed at substantially the same time, the load reduction is greater and an even larger gain setting value can enable the pump speed to return to the target pump speed more quickly.

In the examples above, the system is used to account for increases in the pump motor speed caused by closing a valve and reducing the load on the pump motor. The same method can be used to account for decreases in the pump speed caused by opening a valve and increasing the load on the pump motor. However, in some situations, the increased sensitivity of the pump controller resulting from increasing the value of the gain setting may only be desired to control over-speed conditions (i.e., when the actual pump speed is greater than the target pump speed) as over-speed conditions may result in damage to the pump motor. In such cases, the pump controller 101 is configured to apply the second, higher gain setting only when the actual motor speed exceeds the target motor speed by the defined threshold. The first, lower gain setting value is used when the speed deviation is less than the threshold and wherever the actual speed is less than the target speed.

Thus, the invention provides, among other things, a system and method for controlling the speed of a pump motor to more rapidly adapt to changes in load by adjusting a gain value. Various features and advantages of the invention are set forth in the following claims.

What is claimed is:

1. A pump system comprising:

a pump configured to move a liquid through the pump system, the pump including a pump motor;

a pump controller configured to:

determine a difference between an actual motor speed and a target motor speed, control the actual motor speed by adjusting a current of the pump motor based on the difference between the actual motor speed and the target motor speed and according to a gain setting, compare the difference between the actual motor speed and the target motor speed with a first threshold for delineating a first gain value from a second gain value, apply the first gain value as the gain setting when the difference between the actual motor speed and the target motor speed does not exceed the first threshold, apply the second gain value as the gain setting when the difference between the actual motor speed and the target motor speed exceeds the first threshold, the second gain value being greater than the first gain value, compare the difference between the actual motor speed and the target motor speed with a second threshold for delineating the second gain value from a third gain value, apply the second gain value as the gain setting when the difference between the actual motor speed and the target motor speed exceeds the first threshold and the difference does not exceed the second threshold, and apply the third gain value as the gain setting when the difference between the actual motor speed and the target motor speed exceeds both the first threshold and the second threshold, the third gain value being greater than both the first gain value and the second gain value; and a first valve, wherein the first valve is coupled to the pump system such that closing the first valve reduces a load on the pump motor and results in an increase of the actual motor speed, and wherein the first valve is coupled to the pump system such that the difference between the target motor speed and the actual motor speed immediately after the first valve is closed exceeds the second threshold.

2. The pump system of claim 1, wherein increasing the gain setting causes the pump controller to adjust the current applied to the pump motor with greater sensitivity in response to the difference between the actual motor speed and the target motor speed.

3. The pump system of claim 1, wherein the pump controller adjusts the current applied to the pump motor according to a proportional-integral control loop.

4. The pump system of claim 1, wherein the second gain value is a gain value that is 50% greater than the first gain value.

5. The pump system of claim 1, wherein the pump controller is further configured to apply the first gain value as the gain setting when the actual motor speed is less than the target motor speed, apply the first gain value as the gain setting when the actual motor speed exceeds the target motor speed and the difference between the actual motor speed and the target motor speed is less than the first threshold, and apply the second gain value as the gain setting when the actual motor speed exceeds the target motor speed and the difference between the actual motor speed and the target motor speed exceeds the first threshold.

6. The pump system of claim 1 claim 4, wherein the third gain value is a gain value that is 100% greater than the first gain value.

7. The pump system of claim 1, wherein the pump controller is further configured to apply the first gain value as the gain setting when the actual motor speed is less than the target motor speed, apply the first gain value as the gain setting when the actual motor speed exceeds the target motor speed and the difference between the actual motor speed and the target motor speed is less than the first threshold, and apply the second gain value as the gain setting when the actual motor speed exceeds the target motor speed, the difference between the actual motor speed and the target motor speed exceeds the first threshold, and the difference between the actual motor speed and the target motor speed does not exceed the second threshold, and apply the third gain value as the gain setting when the actual motor speed exceeds the target motor speed and the difference between the actual motor speed and the target motor speed exceeds both the first threshold and the second threshold.

8. The pump system of claim 1, wherein the pump controller includes a processor and a memory, the memory storing instructions that, when executed by the processor, cause the pump controller to operate the pump system.

9. The pump system of claim 1, wherein the second gain value is a gain value that is 100% greater than the first gain value.

10. A motor controller comprising a processor and a memory, the memory storing instructions that, when executed by the processor, cause the motor controller to:

determine a difference between an actual motor speed and a target motor speed, control the actual motor speed by adjusting a current applied to a motor based on the difference between the actual motor speed and the target motor speed according to a gain setting, wherein increasing the gain setting causes the motor controller to adjust the current applied to the motor with greater sensitivity in response to the difference between the actual motor speed and the target motor speed;

compare the difference between the actual motor speed and the target motor speed with a first threshold and a second threshold for determining a gain value to apply;

apply a first gain value as the gain setting when the different between the actual motor speed and the target motor speed does not exceed the first threshold;

apply a second gain value as the gain setting when the difference between the actual motor speed and the target motor speed exceeds the first threshold and does not exceed the second threshold, the second gain value being greater than the first gain value;

compare the difference between the actual motor speed and the target motor speed with the second threshold for delineating the second gain value from a third gain value, apply the third gain value as the gain setting when the difference between the actual motor speed and the target motor speed exceeds both the first threshold and the second threshold, the third gain value being greater than both the first gain value and the second gain value; and control a first valve, wherein the first valve is coupled to the motor such that closing the first valve reduces a load on the motor and results in an increase of the actual motor speed, and wherein the first valve is coupled to the motor such that the difference between the target motor speed and the actual motor speed immediately after the first valve is closed exceeds the second threshold.

11. The motor controller of claim 10 wherein the motor controller adjusts the current applied to the motor according to a proportional-integral control loop.

12. The motor controller of claim 10, wherein the second gain value is a gain value that is 50% greater than the first gain value, and wherein the third gain value is a gain value that is 100% greater than the first gain value.

13. The motor controller of claim 10, wherein the motor controller is further configured to apply the first gain value as the gain setting when the actual motor speed is less than the target motor speed, apply the first gain value as the gain setting when the actual motor speed exceeds the target motor speed and the difference between the actual motor speed and the target motor speed is less than the first threshold, and apply the second gain value as the gain setting when the actual motor speed exceeds the target motor speed, the difference between the actual motor speed and the target motor speed exceeds the first threshold, and the difference between the actual motor speed and the target motor speed does not exceed the second threshold, and apply the third gain value as the gain setting when the actual motor speed exceeds the target motor speed and the difference between the actual motor speed and the target motor speed exceeds both the first threshold and the second threshold.

14. The motor controller of claim 10, wherein the second gain value is a gain value that is 100% greater than the first gain value.

* * * * *